US011168850B1

(12) United States Patent
Shao

(10) Patent No.: US 11,168,850 B1
(45) Date of Patent: Nov. 9, 2021

(54) SPOOL ASSEMBLY FOR RECEIVING LIGHT STRING

(71) Applicant: BLOOMING INTERNATIONAL LIMITED, British West Indies (AI)

(72) Inventor: Shu-Fa Shao, Taipei (TW)

(73) Assignee: Blooming International Limited, British West Indies (AI)

( * ) Notice: Subject to any disclaimer, the term of this patent is extended or adjusted under 35 U.S.C. 154(b) by 0 days.

(21) Appl. No.: 17/106,370

(22) Filed: Nov. 30, 2020

(30) Foreign Application Priority Data

Oct. 13, 2020 (CN) ..... 202011090177.7

(51) Int. Cl.

| | |
|---|---|
| ***F21S 4/10*** | (2016.01) |
| ***B65H 75/44*** | (2006.01) |
| ***F21V 23/00*** | (2015.01) |
| ***B65H 75/28*** | (2006.01) |
| ***F21V 23/02*** | (2006.01) |

(Continued)

(52) U.S. Cl.
CPC ..... *F21S 4/10* (2016.01); *B65H 75/28* (2013.01); *B65H 75/4457* (2013.01); *F21V 23/001* (2013.01); *F21V 23/007* (2013.01); *F21V 23/026* (2013.01); *F21V 23/0435* (2013.01); *B65H 75/14* (2013.01); *B65H 2701/34* (2013.01); *B65H 2701/3915* (2013.01); *F21V 23/06* (2013.01)

(58) Field of Classification Search
CPC .... F21S 4/00; F21S 4/10; B65H 75/14; B65H 75/28; B65H 75/285; B65H 75/4457; B65H 2701/34; B65H 2701/3915; F21V 23/001; F21V 23/003; F21V 23/007; F21V 23/026; F21V 23/0435; F21V 23/045; F21V 23/06
See application file for complete search history.

(56) References Cited

U.S. PATENT DOCUMENTS 2,816,718 A 12/1957 Chewning
4,557,430 A 12/1985 Bonhard
(Continued)

OTHER PUBLICATIONS

Admitted Prior Art (pre Nov. 2020), "Photograph of Light String Adapter One", 1 page.
(Continued)

*Primary Examiner* — Alan B Cariaso
(74) *Attorney, Agent, or Firm* — Christensen, Fonder, Dardi & Herbert PLLC

(57) ABSTRACT

A spool assembly for receiving light string, including a winding device and a power transformer. The winding device includes a winding portion, a first flange, and a second flange. The winding portion includes a first end and a second end. The first flange and the second flange respectively extend outwardly from the first end and the second end. The first flange and the second flange respectively define at least one first latching hole and at least two latching holes. The power transformer includes a power conversion circuit and a housing. The power conversion circuit is arranged in the housing, and the power conversion circuit is configured to convert external power into driving power for the light string. The housing further includes at least one protruding portion protruding from the housing and configured to be engaged into one of the first latching hole and the second latching hole.

11 Claims, 16 Drawing Sheets

(51) Int. Cl.

| | |
|---|---|
| ***F21V 23/04*** | (2006.01) |
| ***F21V 23/06*** | (2006.01) |
| ***B65H 75/14*** | (2006.01) |

(56) References Cited

U.S. PATENT DOCUMENTS

| | | | | |
|---|---|---|---|---|
| D286,134 | S | 10/1986 | Schwartz | |
| D289,603 | S | 5/1987 | An | |
| D314,910 | S | 2/1991 | VanSkiver | |
| D329,975 | S | 10/1992 | Klawitter | |
| 5,381,899 | A | 1/1995 | Rabbitt | |
| 5,598,985 | A | 2/1997 | Winesett | |
| 5,641,075 | A | 6/1997 | Mechlin | |
| 5,676,250 | A | 10/1997 | Walters | |
| 5,695,148 | A | 12/1997 | Christensen | |
| 5,957,401 | A | 9/1999 | O'Donnell | |
| 5,992,627 | A | 11/1999 | Lai | |
| 6,431,489 | B1 | 8/2002 | Rose | |
| 6,467,623 | B1 | 10/2002 | Lewis et al. | |
| 6,557,792 | B1 | 5/2003 | Snow | |
| 6,758,314 | B2 | 7/2004 | Woodruff | |
| 6,783,093 | B2 | 8/2004 | Limber | |
| 6,823,993 | B1 | 11/2004 | Cruze | |
| 7,017,743 | B1 | 3/2006 | Patterson | |
| 7,306,101 | B2 | 12/2007 | Murry | |
| 7,318,561 | B1 | 1/2008 | Giampietro | |
| D611,409 | S | 3/2010 | Green et al. | |
| D689,819 | S | 9/2013 | Olsson et al. | |
| D694,183 | S | 11/2013 | Matsuoka et al. | |
| 8,955,680 | B1 * | 2/2015 | Wu Lee | B65H 75/4473 206/420 |
| D731,969 | S | 6/2015 | Ackloo | |
| D732,472 | S | 6/2015 | Laffon et al. | |
| D819,566 | S | 6/2018 | Hung et al. | |
| 10,026,277 | B2 * | 7/2018 | Huo | B65H 75/4486 |
| 10,028,360 | B1 | 7/2018 | Chen | |
| D845,898 | S | 4/2019 | Laffon de Mazieres et al. | |
| 10,683,974 | B1 | 6/2020 | Chen | |
| D915,643 | S | 4/2021 | Liang | |
| 2004/0007640 | A1 * | 1/2004 | West | B65H 75/06 242/402 |
| 2006/0186253 | A1 | 8/2006 | Smith | |
| 2014/0110150 | A1 * | 4/2014 | Huang | B65H 75/4471 174/135 |
| 2014/0339352 | A1 * | 11/2014 | Iwami | B65H 75/28 242/405 |
| 2017/0227729 | A1 * | 8/2017 | Marcouiller | B65H 75/26 |
| 2019/0356074 | A1 | 11/2019 | Fuda | |
| 2021/0062984 | A1 * | 3/2021 | Yu | F21V 23/005 |

OTHER PUBLICATIONS

Admitted Prior Art (pre Nov. 2020), "Photograph of Light String Adapter Two", 1 page.

Admitted Prior Art (pre Nov. 2020), "Photograph of Light String Adapter Three", 2 pages.

Admitted Prior Art (pre Nov. 2020), "Photograph of Light String Reel With Adapter Four", 4 pages.

* cited by examiner

SPOOL ASSEMBLY FOR RECEIVING LIGHT STRING

CROSS-REFERENCE TO RELATED APPLICATION

The present application claims priority to Chinese Patent Application No. 202011090177.7, filed on Oct. 13, 2020, said application is incorporated by reference in its entirety herein.

FIELD OF THE INVENTION

The disclosure relates to the storage of a light string, in particular, to a spool assembly for receiving the light string.

BACKGROUND

Usually a light string illumination device includes a light string and a power transformer. A power-receiving end of the light string is electrically connected to the power transformer. The transformer has rectification and transformation functions, and is usually set in the form of an alternating-current (AC) power plug. The power transformer is used to connect an AC power socket to receive the external AC power. The power transformer converts the external AC power into driving power with appropriate voltage and frequency to drive the light string to emit light. The power transformer may be equipped with a switch for turning on or turning off the light string, and even switching the flashing frequency of the light string.

SUMMARY

Generally, one way to store the light string is to wind the light string onto a spool. However, the free end of the light string is not fixed, and the weight of the power transformer makes the free end hang down, so that the free end will contribute to the light string coming out of the spool, which is not conducive to the storage and carrying of the light string.

In view of the above problem, this disclosure discloses a spool assembly for receiving a light string, which can effectively maintain the light string in a stored state.

In one or more embodiments, this disclosure discloses a spool system or assembly for receiving one or more light strings, including a spool or winding device and a power transformer. The winding device includes a winding portion, about which the light string is wound, a first flange, and a second flange. The winding portion includes a first end and a second end arranged along a longitudinal direction. The first flange extends outward from the first end and is perpendicular to the longitudinal direction, and the first flange further includes at least one first latching hole. The second flange extends outward from the second end and is perpendicular to the longitudinal direction, and the second flange further includes at least one second latching hole. The power transformer includes a power conversion circuit and a housing. The power conversion circuit is arranged in the housing, and the power conversion circuit is configured to convert external power into driving power. The housing further includes at least one protruding portion protruding from the housing and configured to be engaged into one of the first latching hole and the second latching hole.

In one or more embodiments of this disclosure, the housing includes a front end surface, a rear end surface, a first lateral surface, and a second lateral surface; the front end surface and the rear end surface are arranged opposite to each other. The first lateral surface and the second lateral surface are arranged opposite to each other, and connect the front end surface and the rear end surface; and the at least one protruding portion includes at least one first protruding portion and at least one second protruding portion, the first protruding portion protrudes from the first lateral surface and is configured to be engaged into the first latching hole, and the second protruding portion protrudes from the second lateral surface and is configured to be engaged into the second latching hole.

In one or more embodiments of this disclosure, a projection of the first latching hole on the second flange overlaps the second latching hole.

In one or more embodiments of this disclosure, the first latching hole and the second latching hole are elongated slot-holes and arranged in parallel to each other.

In one or more embodiments of this disclosure, the spool system further includes a remote controller and a remote control signal receiver; wherein the remote controller is configured to send a remote control switching signal, the remote control signal receiver is electrically connected to the power conversion circuit and configured to receive the remote control switching signal, and the remote control signal receiver transfers the remote control switching signal to the power conversion circuit to modulate the driving power of the power conversion circuit.

In one or more embodiments of this disclosure, the spool system further includes a remote controller; wherein the remote controller is configured to send a remote control switching signal, to modulate the driving power of the power conversion circuit.

In one or more embodiments of this disclosure, the first flange includes a first affixing slot, the second flange includes a second affixing slot, and two opposite edges of the remote controller are configured to be engaged into the first affixing slot and the second affixing slot.

In one or more embodiments of this disclosure, the winding device includes two affixing hooks disposed on an outer side surface of the first flange; the two affixing hooks are arranged opposite to each other and configured to withhold two opposite edges of the remote controller, so as to affix the remote controller onto the first flange.

In one or more embodiments of this disclosure, the winding device includes a plurality of affixing structures, which may be hooks, disposed on edges of the first flange and the second flange and configured to hold two opposite edges of the remote controller, so as to affix the remote controller to the edges of the first flange and the second flange.

In one or more embodiments of this disclosure, the spool system further includes two third latching holes, two fourth latching holes, a first auxiliary board, and a second auxiliary board; wherein the two third latching holes and the two fourth latching holes are respectively disposed on the first flange and the second flange; the first auxiliary board and the second auxiliary board respectively include a first affixing slot and a second affixing slot; the first auxiliary board and the second auxiliary board are respectively configured to be engaged into the two third latching holes and the two fourth latching hole, and two opposite edges of the remote controller are configured to be engaged into the first affixing slot and the second affixing slot.

In one or more embodiments of this disclosure, the winding portion defines a shaft hole communicating with the first end and the second end and running through the first flange and the second flange; the winding portion further defines an extending slot-hole extending from the shaft hole and communicating with the first end and the second end, and the shaft hole and the extending slot-hole are combined into an elongated slot-hole and the remote controller is configured to be inserted into the elongated slot-hole, so as to affix the remote controller in the shaft hole and the extending slot-hole.

According to one or more embodiments of this disclosure, the power transformer can be affixed to the winding device when the light string is wound on the winding device. The affixed power transformer can anchor or affix the free end of the light string, so that the spool assembly in the stored state will not allow the light string and the power transformer to hang loose, which is conducive to the storage and carrying of the spool assembly.

BRIEF DESCRIPTION OF THE DRAWINGS

This disclosure will become more fully understood from the detailed description given herein below for illustration only, and thus not limitative of this disclosure, wherein.

DETAILED DESCRIPTION

Figure 1:
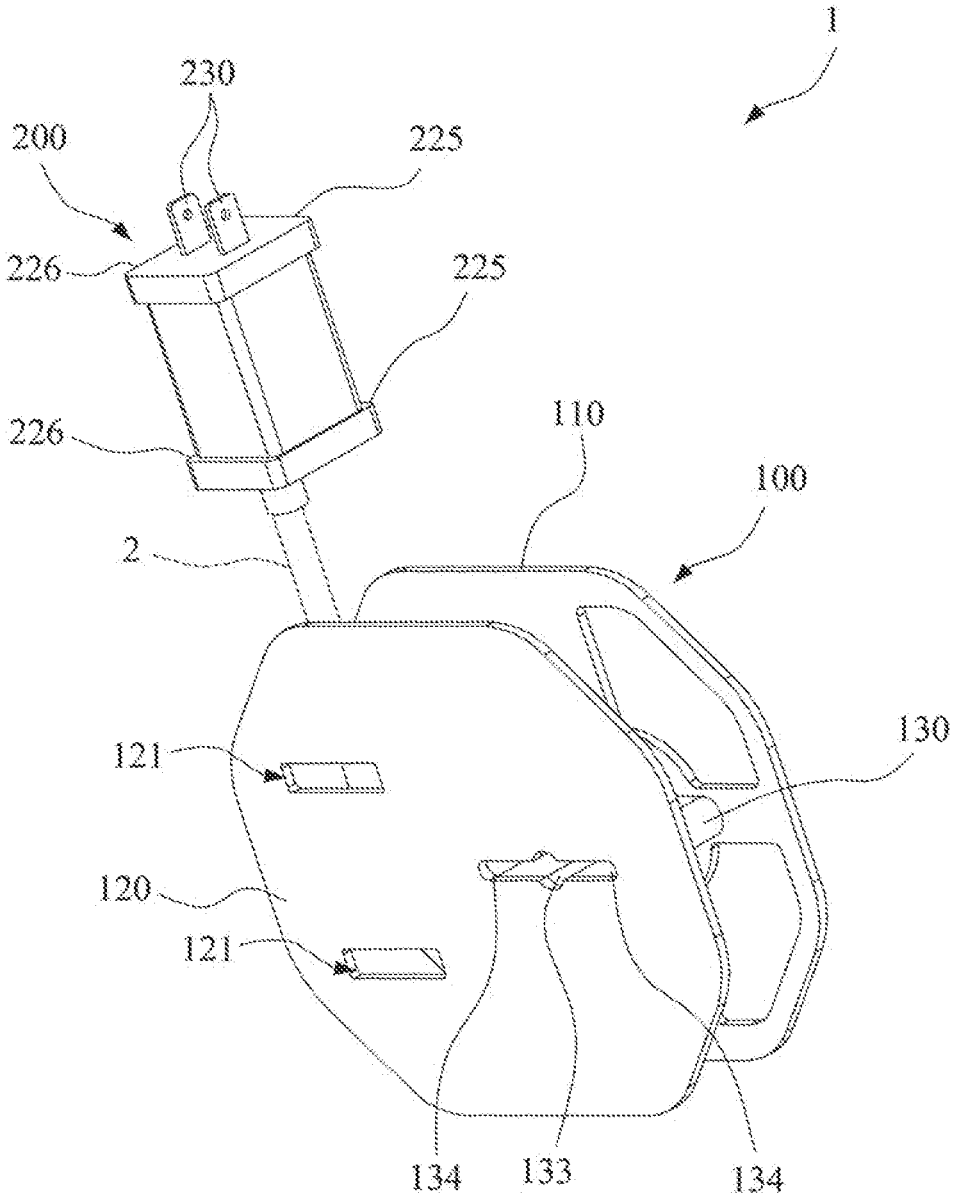
FIG. 1 illustrates a perspective view of the first embodiment of this disclosure.

FIG. 1, FIG. 2, FIG. 3 and FIG. 4 illustrate a spool assembly 1 for receiving a light string 2 according to a first embodiment of this disclosure. In an embodiment, the light string 2 includes a fixed or second end and a free or first end 22. The spool system, which may be an assembly, 1 includes a winding device 100 and a power transformer 200.

As shown in FIG. 1, FIG. 2, FIG. 3 and FIG. 4, in an embodiment, the winding device 100 includes a winding portion 130, a first side or flange 110, and a second side or flange 120. The winding portion 130 includes a first end 131 and a second end 132 arranged along a longitudinal direction between the first end 131 and the second end 132. The light string 2 is configured to be wound on the winding portion 130, so as to anchor or affix an end, i.e., the "fixed end," on the winding portion 130. In particular, in this embodiment, the cross section of the winding part 130 in perpendicular to the longitudinal direction can be any shape, such as a circle, a rectangle, a polygon, or an irregular shape. The shape shown in the drawings is only an example. The cross section is a long and narrow shape, so that the winding portion 130 has a plate shape. The shape of the winding portion 130 of this disclosure is not limited to this configuration.

As shown in FIG. 1, FIG. 2, FIG. 3 and FIG. 4, the winding device 100 also defines one or more latching holes for latching or connecting the transformer 200 to the winding device 100, the latching holes disposed on one of the first flange 110 and the second flange 120. In particular, in this embodiment, the latching holes include one or more first latching holes 111 and one or more second latching holes 121 respectively disposed on the first flange 110 and the second flange 120. Taking the first embodiment as an illustration, the first flange 110 extends outward from the first end 131 and is perpendicular to the longitudinal direction, and the first flange 110 defines two first latching hole 111.

In particular, in this embodiment, the number of the first latching hole 111 may be two or more. In addition, the first latching hole 111 may be configured as an elongated slot-hole. When the number of the first latching holes 111 is two or more, the elongated slot-holes may be arranged in parallel to each other. The second flange 120 extends outward from the second end 132 and is perpendicular to the longitudinal direction, and the second flange 120 defines two second latching holes 121. The number of the second latching hole 121 may be two or more. In addition, the second latching hole 121 may be configured as an elongated slot-hole. When the number of the second latching holes 121 is two or more, the elongated slot-holes may be arranged in parallel to each other. The number of the first latching holes 111 and the number the second latching holes 121 may be the same, and a projection of the first latching holes 111 on the second flange 120 may overlap the second latching holes 121. The aforementioned first latching holes 111 and second latching holes 121 are elongated slot-holes merely for illustration, in other embodiments, the first latching holes 111 and the second latching holes 121 can define other shapes configured to receive portions of the power transformer 200.

As shown in FIG. 1, FIG. 2, FIG. 3 and FIG. 4, and the power transformer 200 is configured to convert external power into driving power, and the free end 22 of the light string 2 is connected to the power transformer 200 to receive the driving power.

Figure 2:
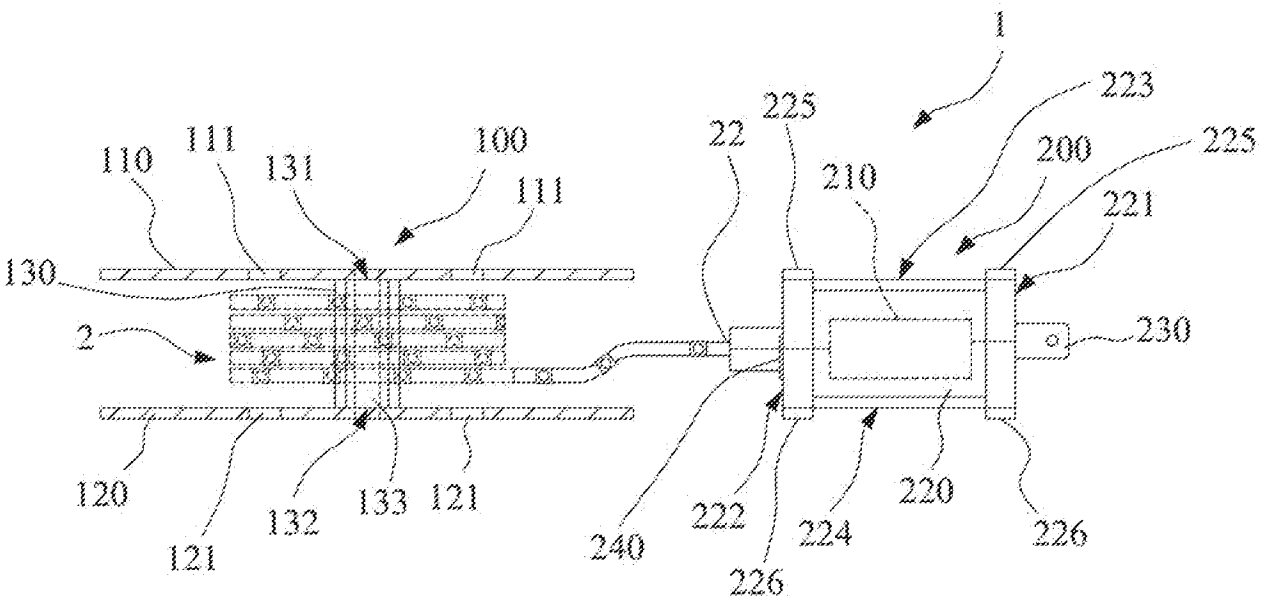
FIG. 2 illustrates a front view of the first embodiment of this disclosure.

As shown in FIG. 2, the power transformer 200 includes a power conversion circuit 210 and a housing 220. The power conversion circuit 210 is arranged in the housing 220, and the free end 22 of the light string 2 is electrically connected to the power conversion circuit 210. The power conversion circuit 210 is configured to convert the external power into the driving power, and the power conversion circuit 210 transfers the driving power to light string 2 so that lights of the light string are powered.

As shown in FIG. 2, the housing 220 includes a front end surface 221, a rear end surface 222, a first lateral surface 223, and a second lateral surface 224. The front end surface 221 and the rear end surface 222 are arranged opposite to each other. The first lateral surface 223 and the second lateral surface 224 are arranged opposite to each other, and connect the front end surface 221 and the rear end surface 222. The free end 22 of the light string 2 is connected to the rear end surface 222 and electrically connected to the power conversion circuit 210.

Figure 3:
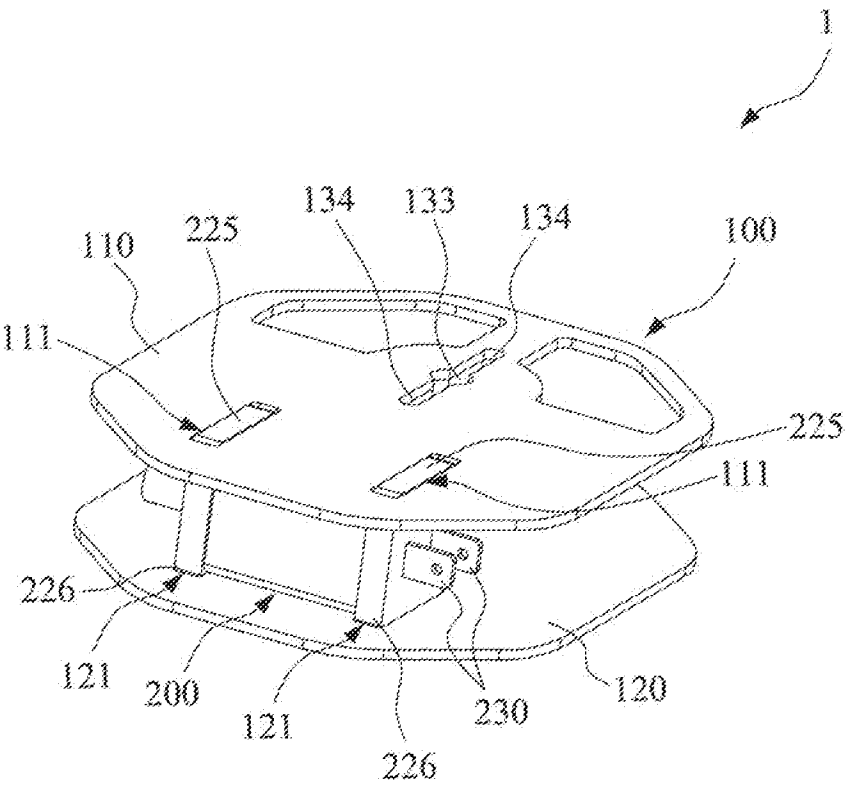
FIG. 3 illustrates another perspective view of the first embodiment of this disclosure.

As shown in FIG. 1, FIG. 2, and FIG. 3, the power conversion circuit 210 is configured to receive the external power and convert it into the driving power through rectification and voltage transformation to drive the light string 2. The power transformer 200 may be in the form of an AC power plug, that is, the power transformer 200 further includes two or more metal sheets, prongs or portions 230 protruding from the surface of the power transformer 200 and electrically connected to the power conversion circuit 210. In one specific embodiment, the two or more metal prongs 230 protrude from the front end surface 221. The two or more metal prongs 230 are configured to plug into an AC power socket to receive the external power.

Figure 4:
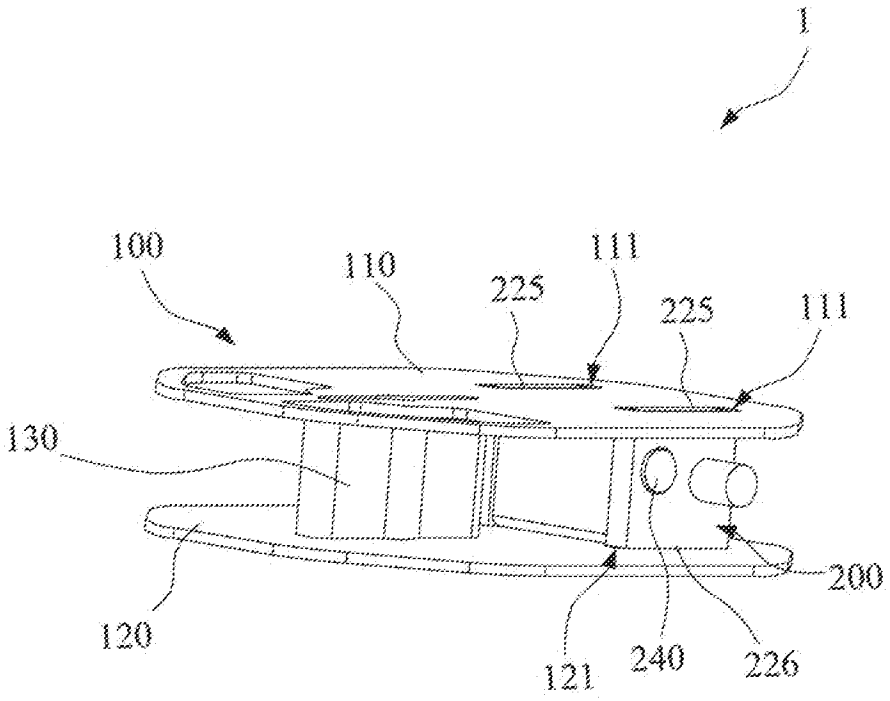
FIG. 4 illustrates yet another perspective view of the first embodiment of this disclosure.

As shown in FIG. 2 and FIG. 4, in an embodiment, the power transformer 200 further includes a switch button 240 disposed on the housing 220 and electrically connected to the power conversion circuit 210. The switch button 240 is configured to be pressed by a user to generate a switch signal to modulate or selectively control the driving power of the power conversion circuit 210. For example, by pressing repeatedly, the output of the power conversion circuit 210 is switched to turn on the light string 2, change a blinking mode of the light string 2, turn off the light string 2, change the color of the lights of the light string, or to selectively perform other functions.

As shown in FIG. 1, FIG. 2, FIG. 3 and FIG. 4, the housing 220 further includes one or more first protruding portions 225 and one or more second protruding portions 226. Specifically, in an embodiment, the number of the first protruding portions 225 matches the number of the first latching holes 111. When there is a plurality of first protruding portions 225, the relative positions of the plurality of first protruding portions 225 are arranged to fit the relative positions of the plurality of first latching holes 111. Similarly, in an embodiment, the quantity of the second protruding portions 226 matches the quantity of the second latching holes 121. When there is a plurality of second protruding portions 226, the relative positions of the plurality of second protruding portions 226 are arranged to fit the relative positions of the plurality of second latching holes 121. In one specific embodiment, the first flange 110 defines two first latching holes 111, the second flange 120 defines two second latching holes 121, and the housing 220 includes two first protruding portions 225 and two second protruding portions 226. In an embodiment, the two first latching holes 111 are arranged in parallel to each other, and the two second latching holes 121 are arranged in parallel to each other.

Figure 5:
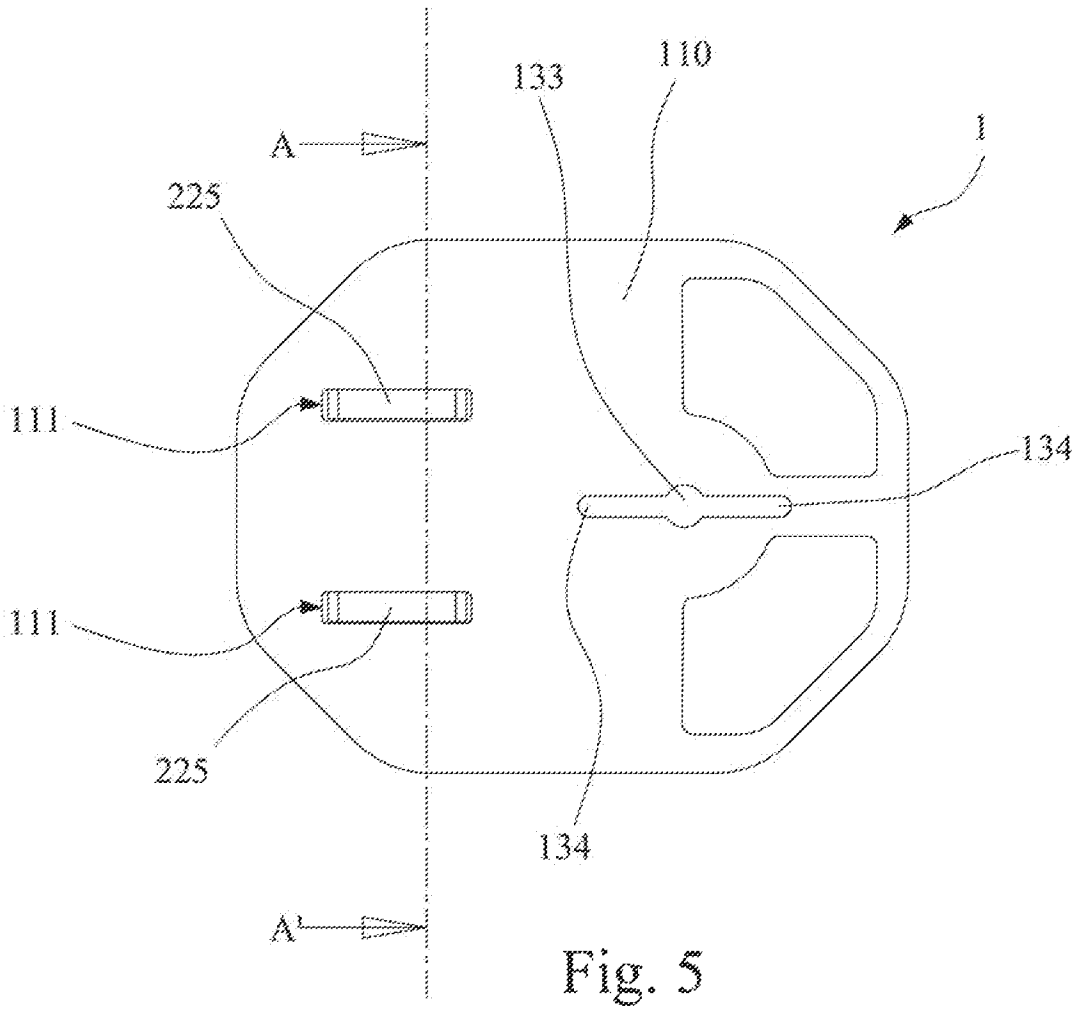
FIG. 5 illustrates a top view of the first embodiment of this disclosure.
Figure 6:
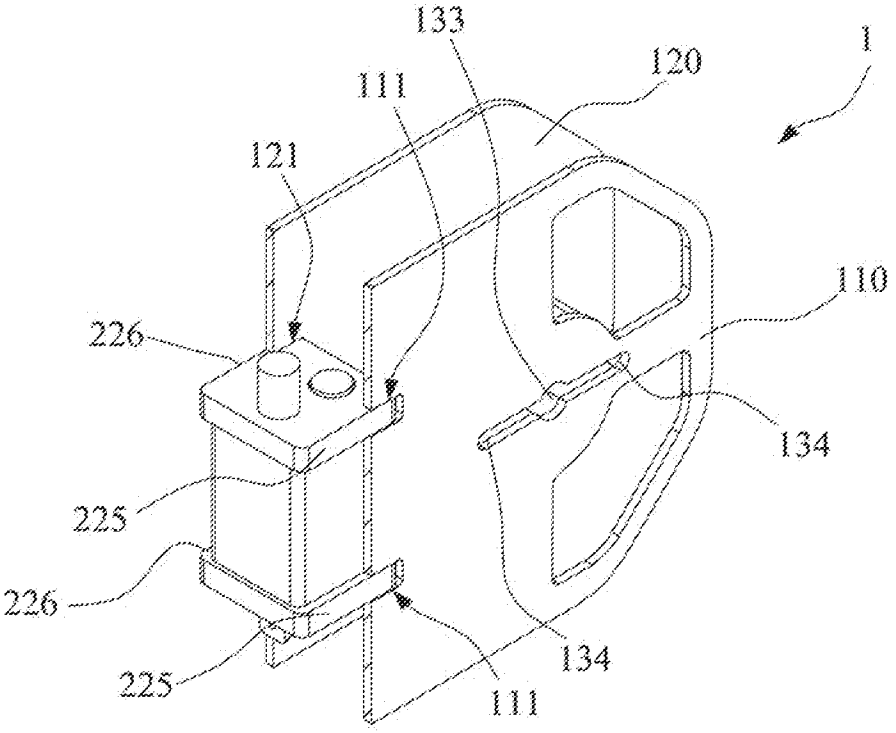
FIG. 6 illustrates a perspective cross-sectional view taken along the line A-A' in FIG. 5.

As shown in FIG. 2, FIG. 5 and FIG. 6, the first protruding portions 225 protrude from the first lateral surface 223, and are configured to be engaged into, or received by, the first latching holes 111. The second protruding portions 226 protrude from the second lateral surface 224, and are configured to be engaged into, or received by, the second latching holes 121. After the light string 2 is on the winding portion 130, the power transformer 200 can be further fixed between the first flange 110 and the second flange 120, which is conducive to the storage and carrying of the light string 2. As mentioned above, the first latching holes 111 and the second latching holes 121 can be of any shapes and are not limited to elongated slots or slot-holes, and the first protruding portions 225 and the second protruding portions 226 are not limited to the long blocks in the drawings. The configurations of the first protruding portions 225 and the second protruding portions 226 are matched with the first latching holes 111 and the second latching holes 121, as long as they can be engaged into the first latching holes 111 and the second latching holes 121.

In this disclosure, the first protruding portion 225 and the second protruding portion 226 may be configured with only one of them; that is, the housing 220 defines only one protruding portion protruding from the surface of the housing 220, and the winding device 100 includes only one latching hole disposed on the first flange 110 or the second flange 120. The distance between the first flange 110 and the second flange 120 is substantially equal to or slightly larger than the distance between the first lateral surface 223 and the second lateral surface 224, so that the protruding portion can engage into the latching hole. In conjunction with the first flange 110 and the second flange 120 clamping the housing 220, in an embodiment, one single latching hole can achieve the purpose of fixing the power transformer 200. In fact, the first flange 110 and the second flange 120 may be configured with latching holes at the same time; that is, the latching holes may include at least one first latching hole 111 and at least one second latching hole 121. When fixing the power transformer 200, the protruding portion can be arbitrarily engaged into one of the first latching hole 111 and the second latching hole 121. Furthermore, multiple groups of latching holes can be arranged on the first flange 110 and the second flange 120, and when affixing the power transformer 200, the protruding portion can be arbitrarily engaged into one, or received by, of the latching holes.

Referring to FIG. 1, FIG. 2, and FIG. 3, the winding portion 130 further defines a shaft hole 133 communicating with the first end 131 and the second end 132 and running through the first flange 110 and the second flange 120. The shaft hole 133 allows a shaft to pass through to set the spool assembly 1 on a plane in a rotatable manner. The winding portion 130, in an embodiment, further includes an extending slot-hole 134 extending from the shaft hole 133 and communicating with the first end 131 and the second end 132.

Figure 7:
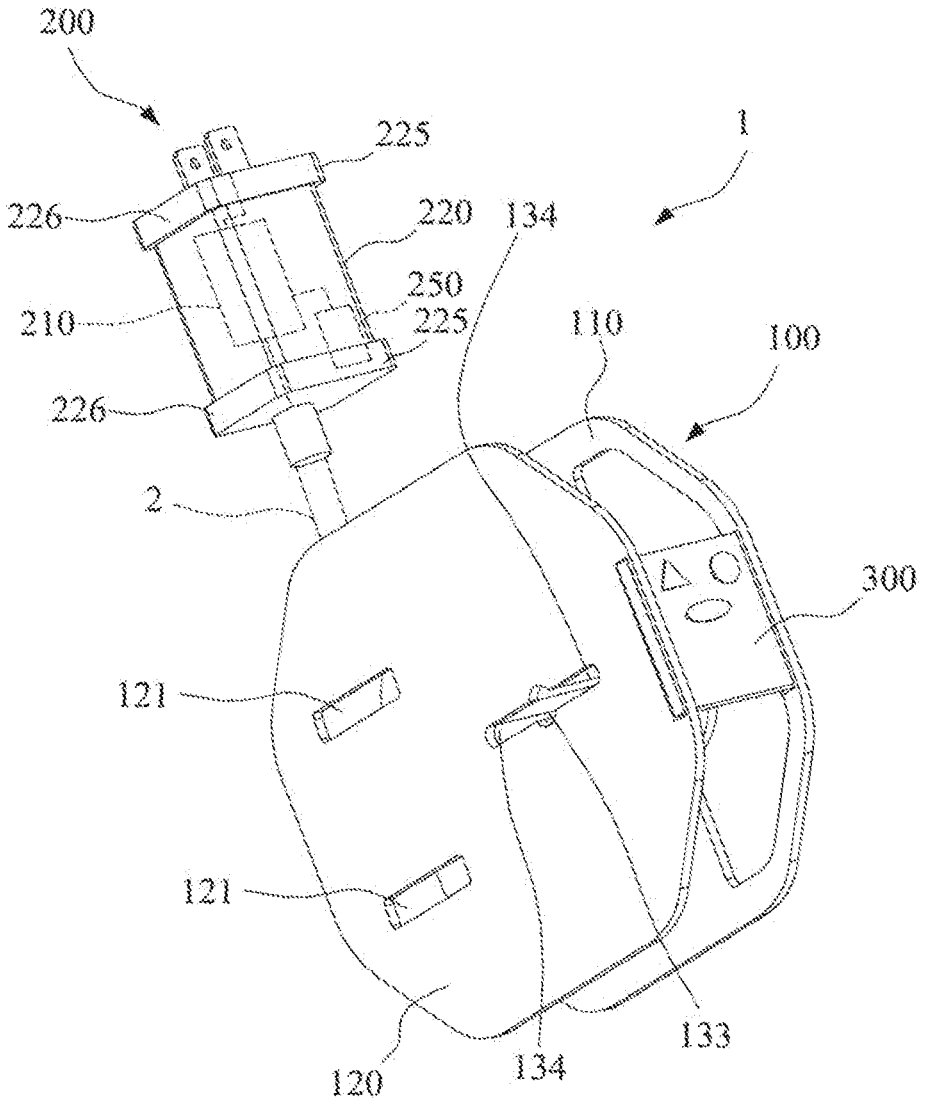
FIG. 7 illustrates a perspective view of a second embodiment of this disclosure.
Figure 8:
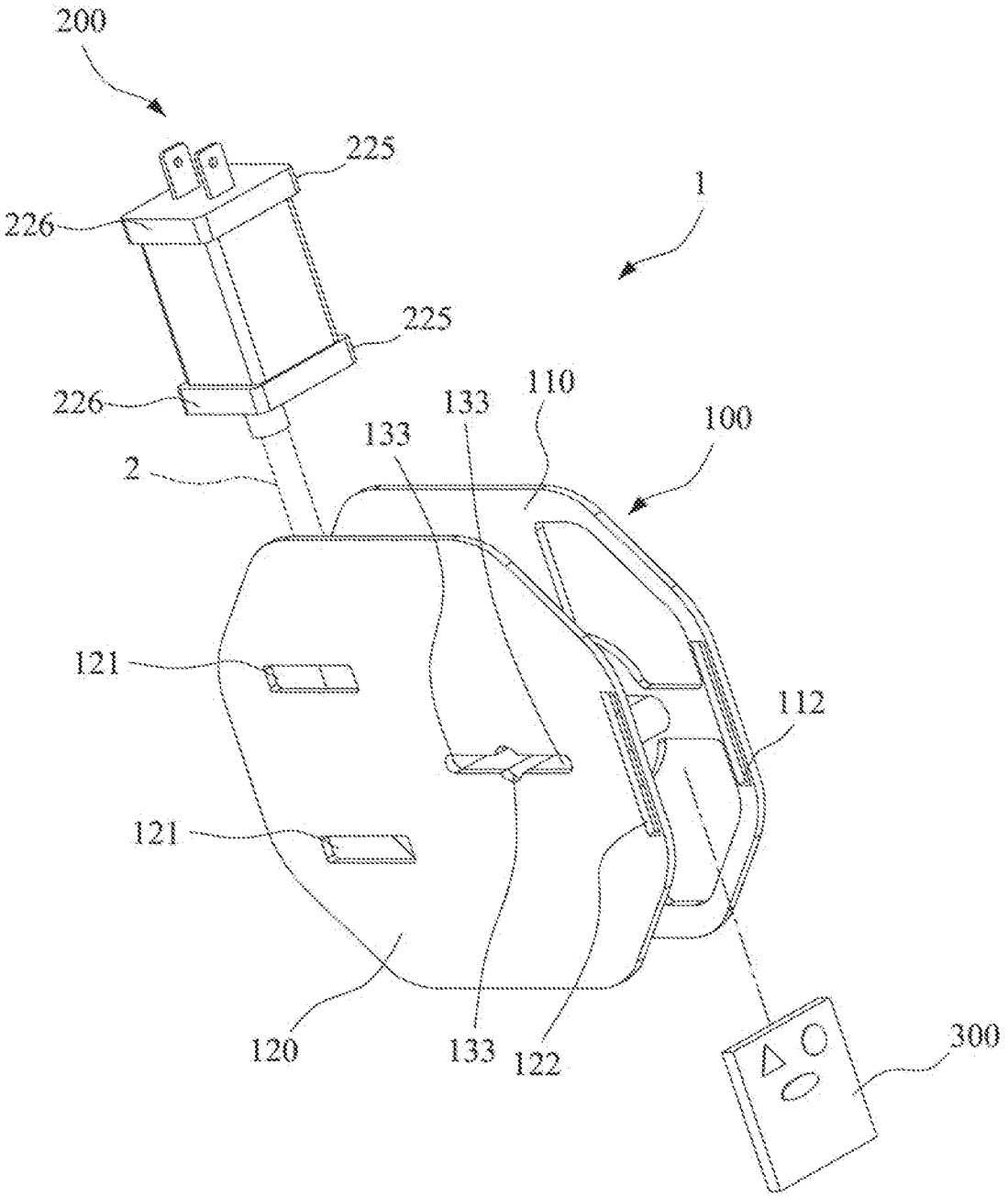
FIG. 8 illustrates another perspective view of the second embodiment of this disclosure.

FIG. 7 and FIG. 8 illustrate a spool assembly 1 for receiving the light string 2 according to a second embodiment of this disclosure. The spool assembly 1 of the second embodiment further includes a remote controller 300 and a remote control signal receiver 250.

As shown in FIG. 7 and FIG. 8, the remote control signal receiver 250 is arranged in the housing 220 and electrically connected to the power conversion circuit 210. The remote control signal receiver 250 is configured to receive a remote control switching signal and transfer the remote control switching signal to the power conversion circuit 210. The remote controller 300 is configured to send the remote control switching signal.

The remote control switching signal is received through the remote control signal receiver 250 and transmitted to the power conversion circuit 210, so as to modulate or control the driving power output by the power conversion circuit 210; for example, the output of the power conversion circuit 210 is switched to turn on the light string 2, change the blinking or other mode of the light string 2, or turn off the light string 2. In addition, the first flange 110 includes a first affixing slot 112, the second flange 120 includes a second affixing slot 122, and two opposite edges of the remote controller 300 are configured to be engaged into the first affixing slot 112 and the second affixing slot 122. Therefore, when storing and carrying the spool assembly 1, the remote controller 330 can be combined with the winding device 100 to avoid losing the remote controller 300.

Figure 9:
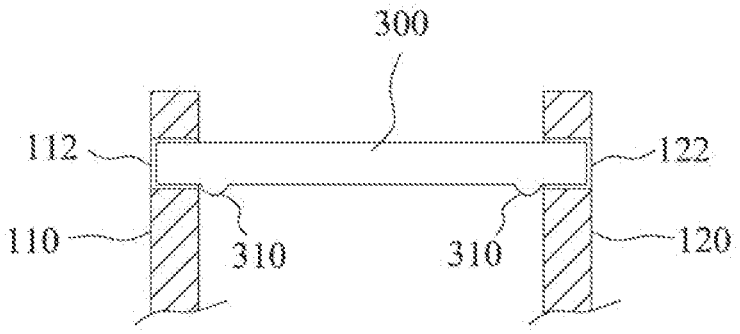
FIG. 9 illustrates a cross-sectional view of the second embodiment of this disclosure.
Figure 10:
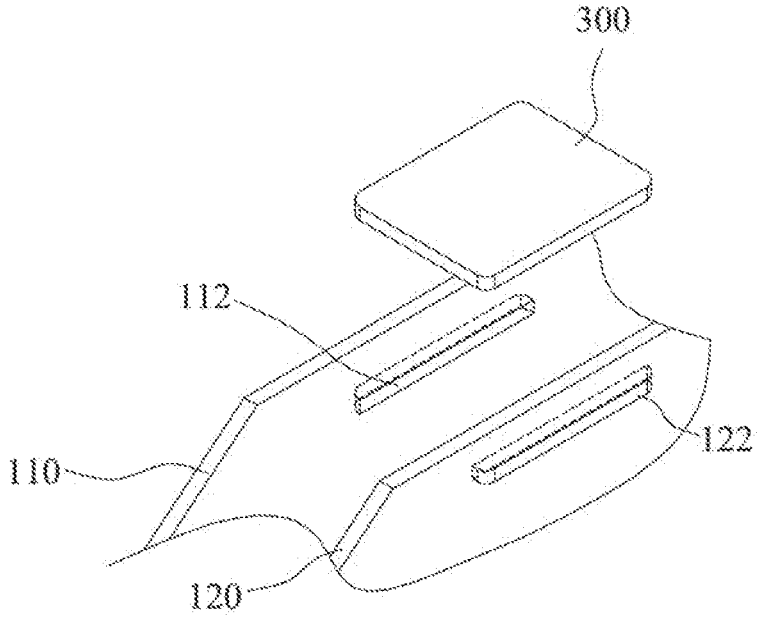
FIG. 10 illustrates a partial exploded view of the second embodiment of this disclosure.

Referring to FIG. 9 and FIG. 10, in an embodiment, the remote controller 300 has a flat structure and may slide in the first fixing slot 112 and the second fixing slot 122 and fall out. Therefore, in an embodiment, an additional positioning structure is required to affix the remote controller 300.

As shown in FIG. 9, in one specific embodiment, at least two bumps 310 are provided on one side of the remote controller 300, respectively corresponding to the first flange 110 and the second flange 120. When the two opposite edges of the remote controller 300 are respectively engaged into the first fixing slot 112 and the second fixing slot 122, the bumps 310 can contact the inner surfaces of the first flange 110 and the second flange 120 to prevent remote controller 300 from sliding and falling out.

As shown in FIG. 10, in another specific embodiment, the first fixing slot 112 and the second fixing slot 122 define tapered holes. The opening of each tapered hole on the inner side surface of the first flange 110 or the second flange 120 is larger than the opening of each tapered hole on the outer side surface of the first flange 110 or the second flange 120. Two opposite edges of the remote controller 300 are provided with rounded corners. The rounded corners are matched with the shape of the tapered holes, so that the two opposite sides are respectively positioned in the first fixing slot 112 and the second fixing slot 122.

Figure 11:
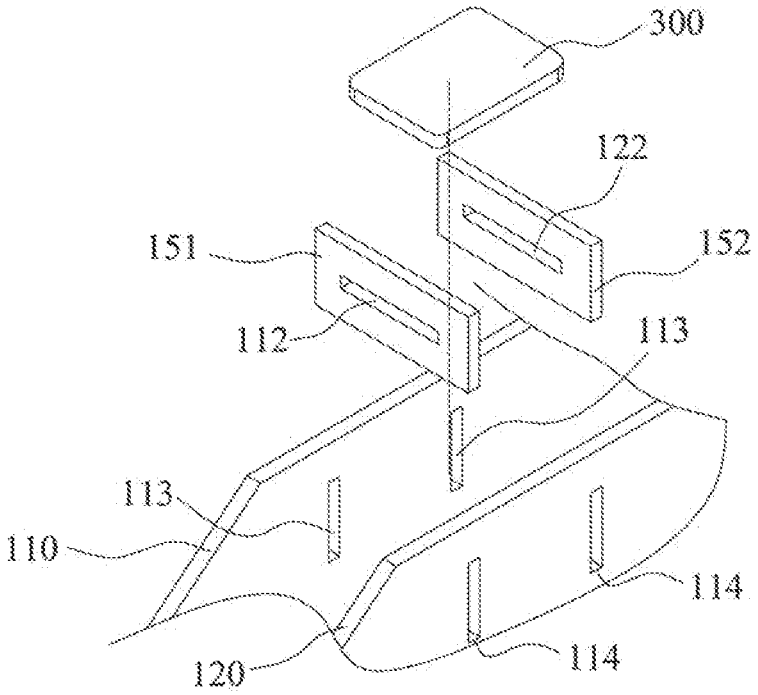
FIG. 11 illustrates a partial exploded view of a third embodiment of this disclosure.
Figure 12:
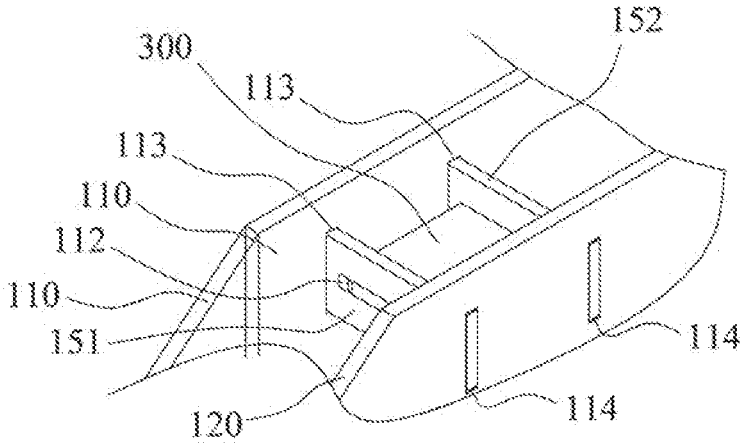
FIG. 12 illustrates a partial perspective view of the third embodiment of this disclosure.

FIG. 11 and FIG. 12 illustrate a spool system 1 for receiving the light string 2 according to a third embodiment of this disclosure. The spool assembly 1 of the third embodiment is substantially the same as that disclosed in the second embodiment, and the difference lies in that the fixing method of the remote controller 300 is different from that in the second embodiment. The remote controller 300 may be replaced with another remote controller 300 having a different size, and the first fixing slot 112 and the second fixing slot 122 may not match the two opposite edges of the new remote controller 300. In the third embodiment, the first flange 110 or the second flange 120 is not configured with the first fixing slot 112 and the second fixing slot 122. Instead, the winding device 100 further defines two third latching holes 113 and two fourth latching holes 114, which are respectively defined in the first flange 110 and the second flange 120. Meanwhile, the spool assembly 1 further includes a first auxiliary board 151 and a second auxiliary board 152, and the first fixing slot 112 and the second fixing slot 122 are respectively disposed on the first auxiliary board 151 and the second auxiliary board 152. The first auxiliary board 151 and the second auxiliary board 152 are respectively engaged into the third latching holes 113 and the fourth latching holes 114, so that the first affixing slot 112 and the second affixing slot 122 are arranged corresponding to each other. The two opposite edges of the remote controller 300 are configured to be engaged into the first affixing slot 112 and the second affixing slot 122. When a new remote controller 300 with a different size is adapted, all that needs to be done is to replace the first auxiliary board 151 and the second auxiliary board 152 with new ones that the new first fixing slot 112 and the new second fixing slot 122 can match to and accommodate the new remote controller 300. The new remote controller 300 is able to be affixed by the new first auxiliary board 151 and the new second auxiliary board 152. The aforementioned bumps 310 or tapered holes can also be applied to this embodiment.

Figure 13:
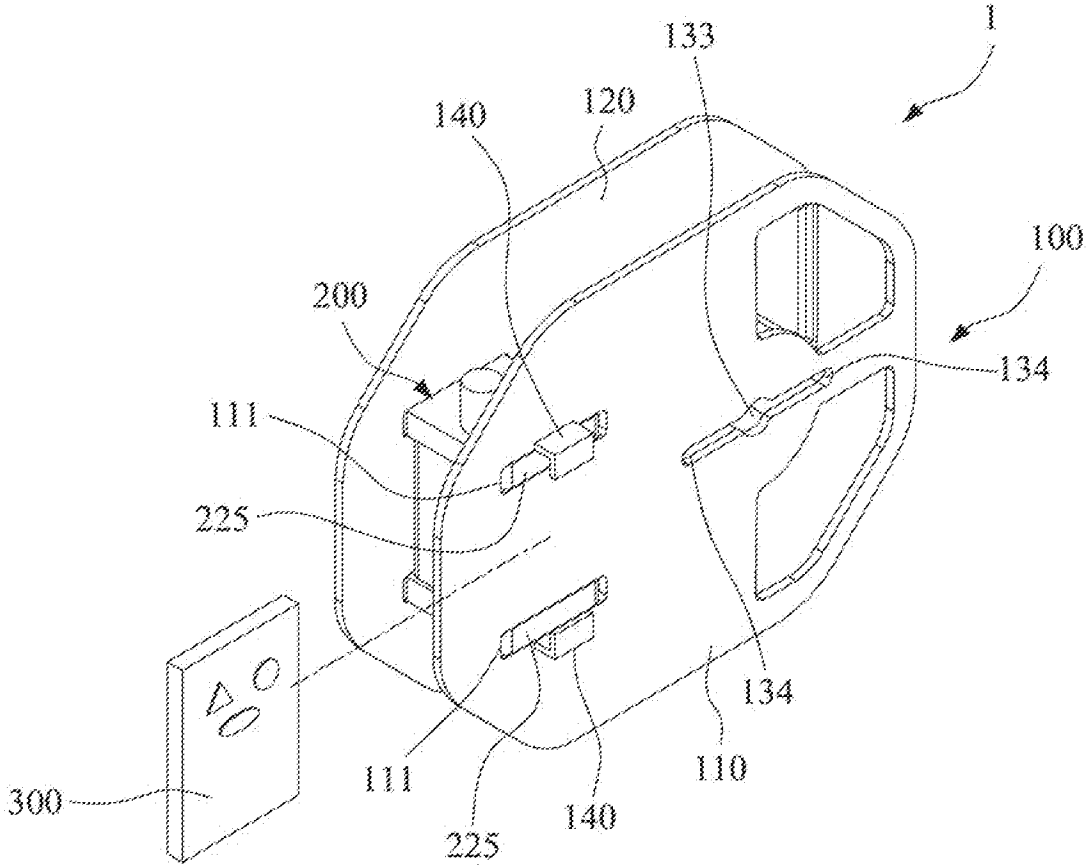
FIG. 13 illustrates a perspective view of a fourth embodiment of this disclosure.
Figure 14:
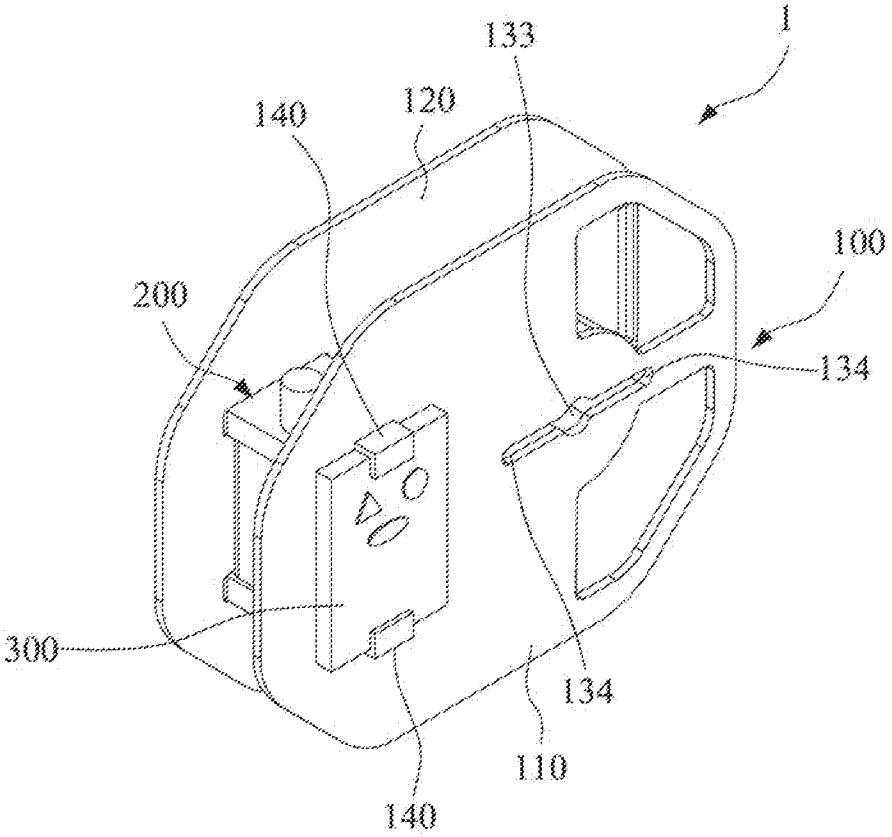
FIG. 14 illustrates another perspective view of the fourth embodiment of this disclosure.

FIG. 13 and FIG. 14 illustrate a spool system 1 for receiving the light string 2 according to a fourth embodiment of this disclosure. The spool system 1 of the fourth embodiment is substantially the same as that disclosed in the second embodiment, and the difference lies in that the affixing method of the remote controller 300 is different from that in the second embodiment.

As shown in FIG. 13 and FIG. 14, the winding device 100 includes two affixing structures, which in an embodiment are hooks 140 disposed on an outer side surface of the first flange 110. The two affixing hooks 140 are arranged opposite to each other to form a clamping area. The two affixing hooks 140 are configured to withhold two opposite edges of the remote controller 300, so as to affix the remote controller 300 on the first flange 110 to avoid losing the remote controller 300.

Figure 15:
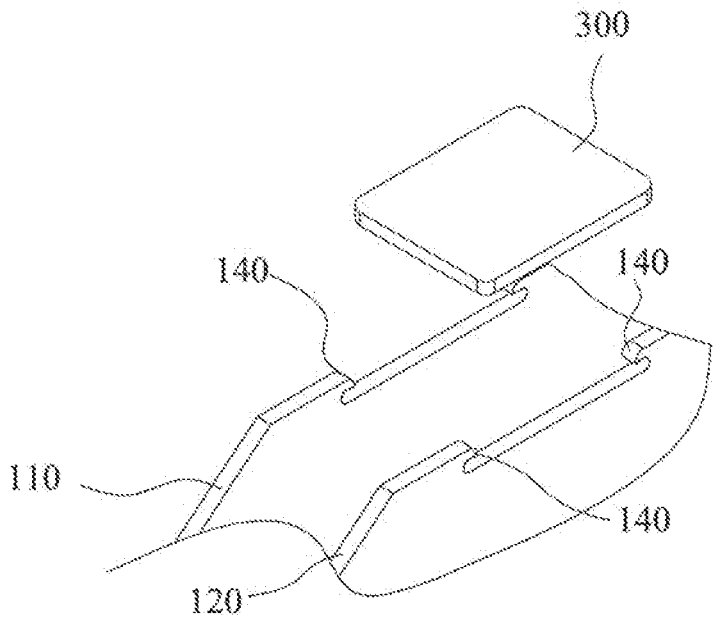
FIG. 15 illustrates a partial exploded view of a modification of this disclosure.
Figure 16:
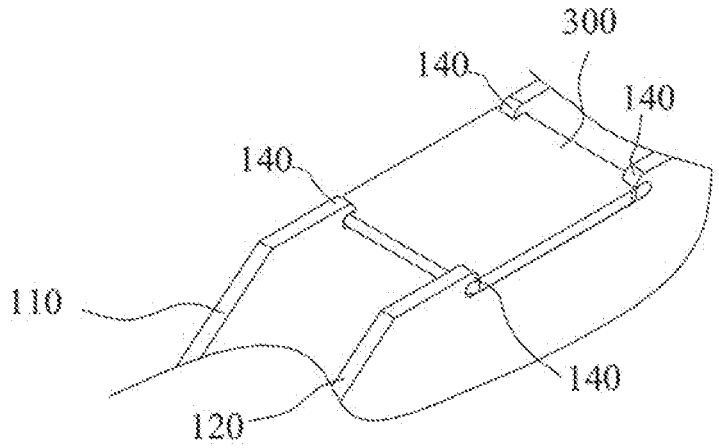
FIG. 16 illustrates a partial perspective view of the modification of this disclosure.

FIG. 15 and FIG. 16 illustrate a modification of the fourth embodiment. In this modification the winding device 100 includes a plurality of affixing hooks 140 disposed on edges of the first flange 110 and the second flange 120 and configured to withhold two opposite edges of the remote controller 300, so as to affix the remote controller 300 on the edges of the first flange 110 and the second flange 120.

Figure 17:
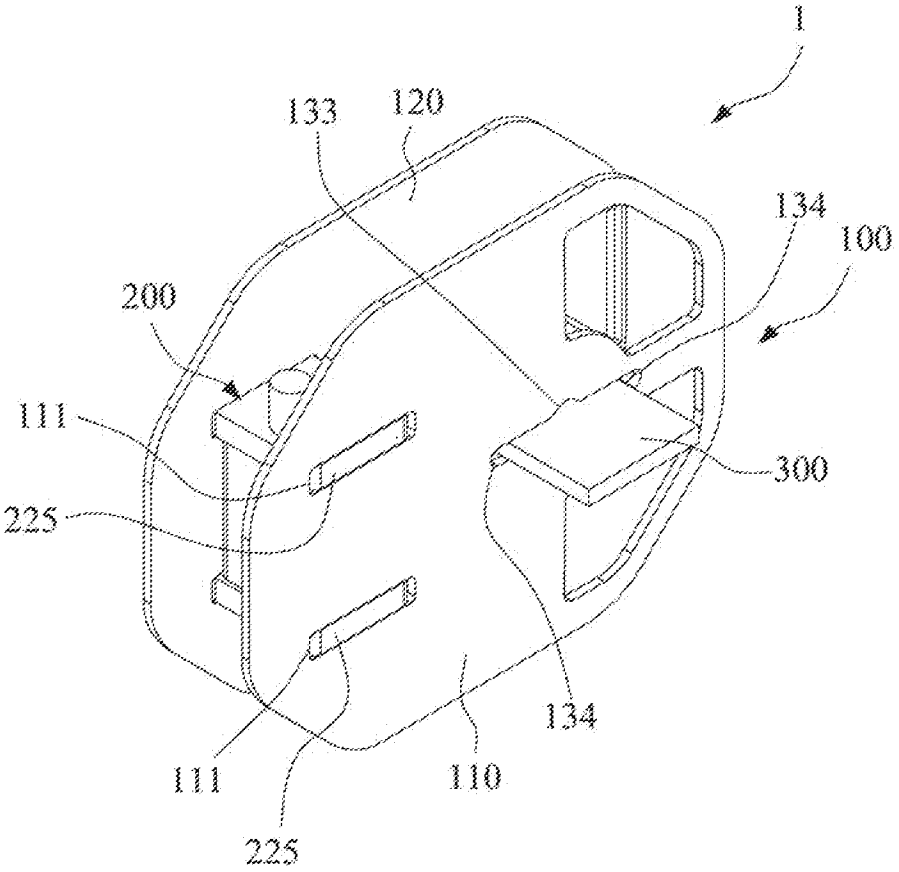
FIG. 17 illustrates a perspective view of another modification of this disclosure.

As shown in FIG. 17, in one or more embodiments of this disclosure, the winding portion 130 further defines a shaft hole 133 communicating with the first end 131 and the second end 132 and running through the first flange 110 and the second flange 120. The winding portion 130 further defines an extending slot-hole 134 extending from the shaft hole 133 and communicating with the first end 131 and the second end 132. In an embodiment, the shaft hole 133 and the extending slot-hole 134 are combined into an elongated slot-hole matching the configuration of the remote controller 300. The remote controller 300 is configured to be inserted into the elongated slot-hole, so as to affix the remote controller 300 in the shaft hole 133 and the extending slot-hole 134 to avoid losing the remote controller 300.

Figure 18:
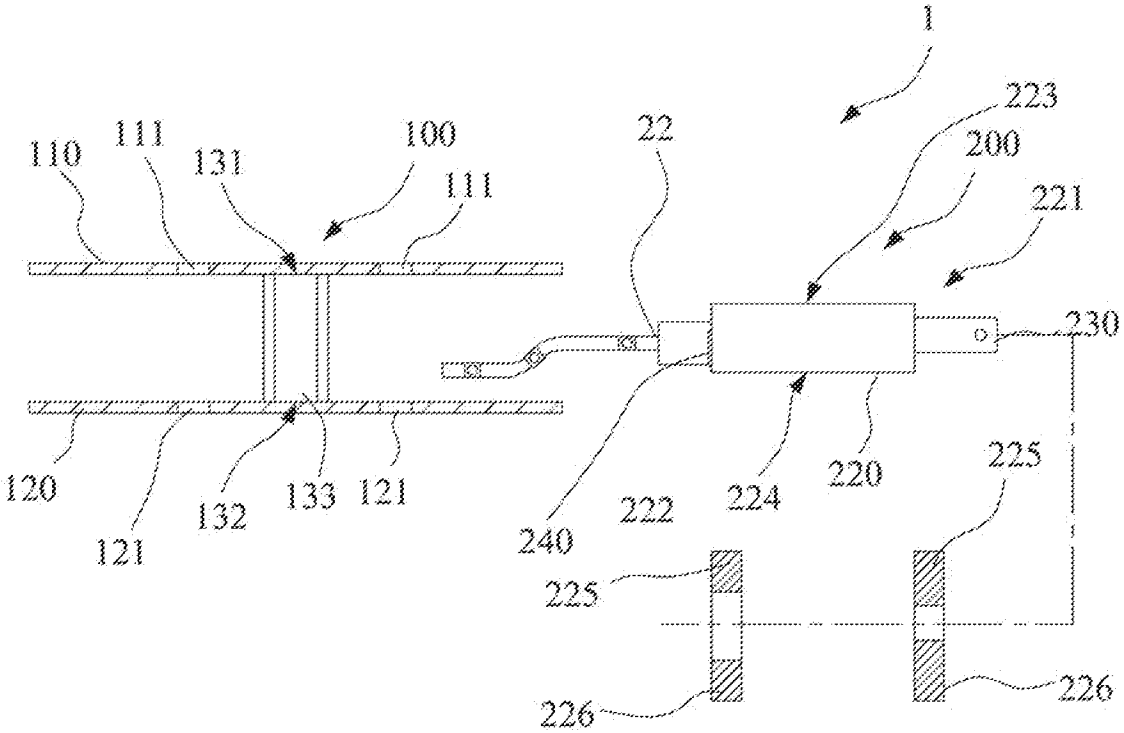
FIG. 18 illustrates a front exploded view of a fifth embodiment of this disclosure.
Figure 19:
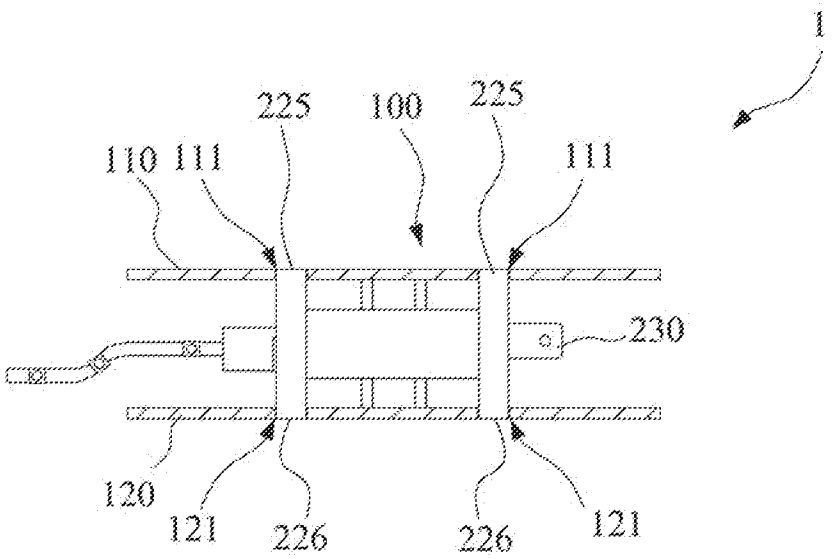
FIG. 19 illustrates a front view of the fifth embodiment of this disclosure.

FIG. 18 and FIG. 19 illustrate a spool system 1 for receiving the light string 2 according to a fifth embodiment of this disclosure. The spool system 1 of the fifth embodiment is substantially the same as that disclosed in the aforementioned embodiments; the difference lies in that the structure of the power transformer 200 of the fifth embodiment is different from that in the other embodiments. The power transformer 200 or the winding device 100 may be replaced with another one having a different size, such that the thickness of the power transformer 200 is not easily accommodated by the first flange 110 and the second flange 120.

In the fifth embodiment, the first protruding portion 225 and the second protruding portion 226 are configured in a detachable form. For example, the first protruding portion 225 and the second protruding portion 226 may be two opposite edges of two plates, and the plates define through holes. The metal power prong 230 or the housing 220 can be inserted into the through holes, so that the first protruding portion 225 and the second protruding portion 226 protrude from the first lateral surface 223 and the second lateral surface 224 of the housing 220. In this case, a distance between the two plates can be adjusted to match the variation of the distance between the first latching holes 111 or the second latching holes 112.

Therefore, when the power transformer 200 or the winding device 100 is replaced with another one having a different size, all that needs to be done is to change the plates, and then new first protruding portions 225 and second protruding portions 226 are attached to the power transformer 200 to match the first latching holes 111 and the second latching holes 112, so as to affix the power transformer 200 to the flanges.

According to one or more embodiments of this disclosure, the power transformer 200 can be affixed to the winding device 100 when the light string 2 is wound on the winding device 100. The affixed power transformer 200 can fix or secure the free end 22 of the light string 2, so that the spool assembly 1 in the stored state will not have the light string 2 and the power transformer 200 hanging loose, which is conducive to the storage and carrying of the spool assembly 1.

What is claimed is:

1. A spool assembly for receiving a light string, comprising:

a winding device, including:

a winding portion, including a first end and a second end, and arranged along a longitudinal direction;

a first flange, extending outwardly from the first end and perpendicular to the longitudinal direction, wherein the first flange defines at least one first latching hole; and a second flange, extending outward from the second end and perpendicular to the longitudinal direction, wherein the second flange defines at least one second latching hole; and a power transformer, including a power conversion circuit and a housing; wherein the power conversion circuit is arranged in the housing, and the power conversion circuit is configured to convert external power into driving power;

wherein the housing further includes at least one protruding portion protruding from the housing and configured to be engaged into one of the at least one first latching hole and the at least one second latching hole.

2. The spool assembly for receiving a light string according to claim 1, further comprising a light string including a fixed end and a free end; wherein the light string is configured to be wound on the winding portion to affix the fixed end onto the winding portion, and the free end is electrically connected to the power conversion circuit to receive the driving power.

3. The spool assembly for receiving a light string according to claim 1, wherein the housing includes a front end surface, a rear end surface, a first lateral surface, and a second lateral surface; the front end surface and the rear end surface are arranged opposite to each other, and the first lateral surface and the second lateral surface are arranged opposite to each other and connect the front end surface and the rear end surface; and the at least one protruding portion includes at least one first protruding portion and at least one second protruding portion, the at least one first protruding portion protrudes from the first lateral surface and is configured to be engaged into the at least one first latching hole, and the at least one second protruding portion protrudes from the second lateral surface and is configured to be engaged into the at least one second latching hole.

4. The spool assembly for receiving a light string according to claim 3, wherein a projection of the at least one first latching hole on the second flange overlaps the at least one second latching hole.

5. The spool assembly for receiving a light string according to claim 3, wherein the at least one first latching hole and the at least one second latching hole are elongated slot-holes and arranged in parallel to each other.

6. The spool assembly for receiving a light string according to claim 1, further comprising a remote controller and a remote control signal receiver; wherein the remote controller is configured to send a remote control switching signal, the remote control signal receiver is electrically connected to the power conversion circuit and configured to receive the remote control switching signal, and the remote control signal receiver transfers the remote control switching signal to the power conversion circuit to modulate the driving power of the power conversion circuit.

7. The spool assembly for receiving a light string according to claim 6, wherein the first flange includes a first fixing slot, the second flange includes a second fixing slot, and two opposite edges of the remote controller are configured to be engaged into the first fixing slot and the second fixing slot.

8. The spool assembly for receiving a light string according to claim 6, wherein the winding device includes two hooks disposed on an outer side surface of the first flange, the two fixing hooks are arranged opposite to each other and configured to withhold two opposite edges of the remote controller, so as to affix the remote controller onto the first flange.

9. The spool assembly for receiving a light string according to claim 6, wherein the winding device includes a plurality of affixing hooks disposed on edges of the first flange and the second flange and configured to withhold two opposite edges of the remote controller, so as to fix the remote controller to the edges of the first flange and the second flange.

10. The spool assembly for receiving a light string according to claim 6, further defining two third latching holes, two fourth latching holes, and further comprising a first auxiliary board, and a second auxiliary board; wherein the two third latching holes and the two fourth latching holes are respectively defined in the first flange and the second flange;

the first auxiliary board and the second auxiliary board respectively define a first fixing slot and a second fixing slot;

the first auxiliary board and the second auxiliary board are respectively configured to be engaged into the two third latching holes and the two fourth latching holes; and two opposite edges of the remote controller are configured to be engaged into the first fixing slot and the second fixing slot.

11. The spool assembly for receiving a light string according to claim 6, wherein the winding portion defines a shaft hole communicating with the first end and the second end and running through the first flange and the second flange;

the winding portion defines an extending slot-hole extending from the shaft hole and communicating with the first end and the second end; and the shaft hole and the extending slot-hole are combined into an elongated slot-hole and the remote controller is configured to be inserted into the elongated slot-hole, so as to fix the remote controller in the shaft hole and the extending slot-hole.

* * * * *